US010943728B2

(12) United States Patent
Park

(10) Patent No.: US 10,943,728 B2
(45) Date of Patent: Mar. 9, 2021

(54) COIL SPACER STRUCTURE FOR MOLDING TRANSFORMER

(71) Applicant: LSIS CO., LTD., Anyang-si (KR)

(72) Inventor: Bum-Joon Park, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 284 days.

(21) Appl. No.: 15/937,003

(22) Filed: Mar. 27, 2018

(65) Prior Publication Data

US 2018/0286571 A1 Oct. 4, 2018

(30) Foreign Application Priority Data

Mar. 28, 2017 (KR) ..... 20-2017-0001530

(51) Int. Cl.
*H01F 27/30* (2006.01)
*H01F 27/32* (2006.01)

(52) U.S. Cl.
CPC ..... *H01F 27/32* (2013.01); *H01F 27/306* (2013.01); *H01F 27/324* (2013.01)

(58) Field of Classification Search
USPC ..... 336/208
See application file for complete search history.

(56) References Cited

FOREIGN PATENT DOCUMENTS

| | | | |
|---|---|---|---|
| JP | H0620852 | A | 1/1994 |
| KR | 100827687 | B1 | 5/2008 |
| KR | 20100120560 | A | 11/2010 |
| KR | 200456321 | Y1 | 10/2011 |
| KR | 101090142 | B1 | 12/2011 |
| WO | 2016017381 | A1 | 4/2016 |

OTHER PUBLICATIONS

WO2016017381 English translation. (Year: 2016).*

* cited by examiner

*Primary Examiner* — Ronald Hinson
(74) *Attorney, Agent, or Firm* — K&L Gates LLP

(57) ABSTRACT

The coil spacer structure according to an embodiment of the present disclosure includes a body block, a low tension coil support member coupled to the body block, and a high tension coil support member coupled to the body block. A plurality of protrusions are formed on an outer peripheral portion of the body block, and a first groove is formed between the protrusions.

4 Claims, 4 Drawing Sheets

COIL SPACER STRUCTURE FOR MOLDING TRANSFORMER

CROSS-REFERENCE TO RELATED APPLICATIONS

Pursuant to 35 U.S.C. § 119(a), this application claims the benefit of earlier filing date and right of priority to Korean Application No. 20-2017-0001530 filed on Mar. 28, 2017, in the Korean Intellectual Property Office, the disclosure of which is hereby incorporated by reference in its entirety.

BACKGROUND

1. Technical Field

The embodiments discussed herein are related to a coil spacer structure for a molding transformer, and more particularly, to a coil spacer structure for a molding transformer capable of enduring a lightning impulse withstand voltage of a high insulation class and at the same time minimizing an arcing distance.

2. Description of the Related Art

Generally, a molding transformer is a dry transformer in which a winding portion is insulated with an epoxy resin, and is a device that converts a specific voltage to a voltage desired by the user.

In addition, the molding transformer is applicable as a pole transformer since, for example, there is no need for repair work on an insulating oil and it is superior in heat resistance, flame retardancy, and the like as compared with an oil immersed transformer.

Such a molding transformer is a transformer in which an iron core and a winding are not immersed in the insulating oil but the winding is solid-insulated by using a resin such as epoxy and generally has the structure in which the high voltage winding and the low voltage winding are separated and molded by epoxy resin, and arranged concentrically around the iron core.

However, in a conventional molding transformer, the side surface of the coil spacer is formed as a single surface, or the cross-sectional shape of the side surface is in the form of a straight line, and thus, a creepage distance required to endure a high lightning impulse voltage is insufficient. Therefore, such a transformer has been implemented as one for a low lightning impulse withstand voltage. In order to reduce the manufacturing cost of the molding transformer, it is necessary to minimize the arcing distance in the air between a high voltage winding portion and ground or the other winding portion. However, there may be a very difficult problems in minimizing the arcing distance in the air while achieving the sufficient creepage distance at the same time.

SUMMARY

The present disclosure is intended to provide a coil spacer structure for a molding transformer that can endure a lightning impulse withstand voltage of a high insulation class while minimizing an arcing distance in the air.

The coil spacer structure according to an exemplary embodiment of the present disclosure includes a body block, a low tension coil support member coupled to the body block, and a high tension coil support member coupled to the body block. A plurality of protrusions may be formed on an outer peripheral portion of the body block, and a first groove may be formed between the protrusions.

In addition, the coil spacer structure may have at least one second groove formed in the outer peripheral portion of the body block.

In addition, in the coil spacer structure, the second groove may be formed in the first groove.

Further, in the coil spacer structure, the ends of the protrusions may be formed to have a curved surface.

In addition, in the coil spacer structure, the ends of the protrusions may be formed to have a plane parallel to the first groove.

In addition, the coil spacer structure may further include a first impact resistant member coupled between the body block and the low tension coil support member, and a second impact resistant member coupled between the body block and the high tension coil support member.

The details of other embodiments are included in the detailed description and the drawings.

According to the present disclosure, it is possible to obtain the coil spacer structure for the molding transformer that can endure the lightning impulse withstand voltage of the high insulation class while minimizing the arcing distance in the air.

It will be appreciated that other various effects, which are not specifically mentioned in the description, can be provided by the embodiments of the present disclosure.

DETAILED DESCRIPTION

The advantages and features of the present disclosure, and how to accomplish them, will become apparent with reference to the embodiments described in detail below with reference to the accompanying drawings. However, the present disclosure is not limited to the embodiments described herein but may be embodied in other forms. Rather, the embodiments disclosed herein are provided so that the disclosure can be thorough and complete, and fully convey the concept of the present disclosure to a person having ordinary skill in the art.

The terminology used herein is for the purpose of describing particular embodiments only and is not intended to be limiting of the present disclosure. The singular forms, such as "a" and "an," include plural forms as well unless the context clearly indicates otherwise. In this application, it is to be understood that the terms "comprise", "have", and the like are used to specify the presence of the described features, numbers, steps, operations, elements, parts, or combinations thereof but do not preclude the presence or addition of one or more other features, numbers, steps, operations, elements, parts, or combinations thereof.

Unless otherwise defined, all terms used herein, including technical or scientific terms, have the same meaning as commonly understood by a person having ordinary skill in the art to which this invention belongs. Terms such as those defined in commonly used dictionaries should be construed as meaning consistent with meaning in the context of the relevant art and are not to be construed in an ideal or overly formal sense unless expressly defined in the present application.

Hereinafter, preferred embodiments of the present disclosure will be described in detail with reference to the accompanying drawings.

Figure 1:
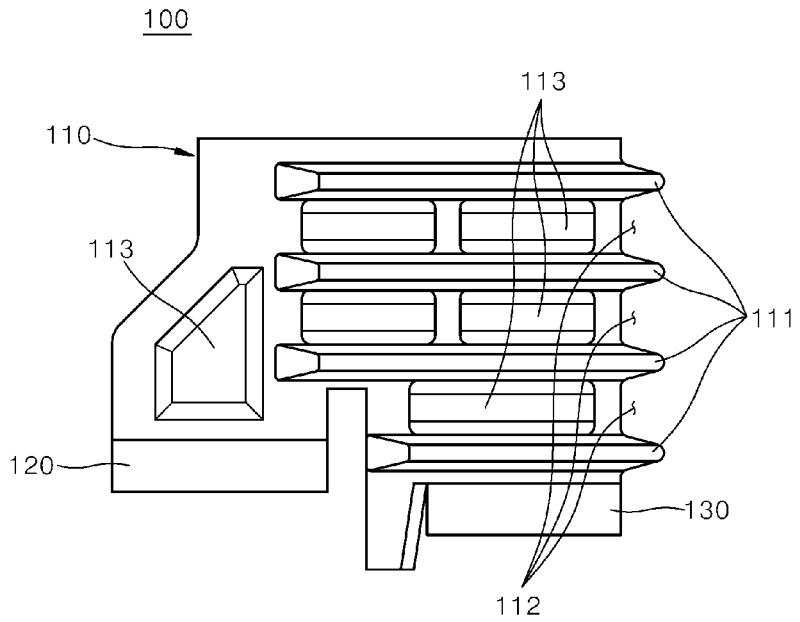
FIG. 1 is a perspective view schematically illustrating a coil spacer structure for a molding transformer according to a first embodiment of the present disclosure.
Figure 2:
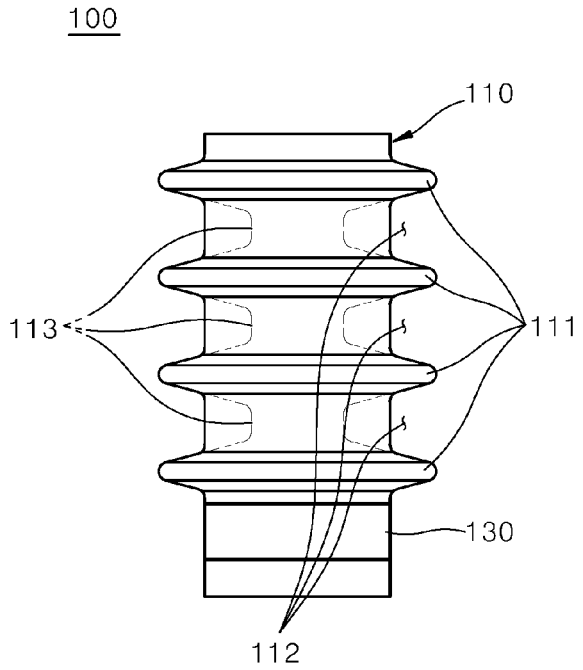
FIG. 2 is a schematic side view of the coil spacer structure illustrated in FIG. 1.

FIG. 1 is a perspective view schematically illustrating a coil spacer structure for a molding transformer according to a first embodiment of the present disclosure, and FIG. 2 is a schematic side view of the coil spacer structure illustrated in FIG. 1.

As illustrated, the coil spacer structure 100 includes a body block 110, a low tension coil support member 120, and a high tension coil support member 130.

More specifically, the body block 110 may be positioned at the upper and lower portions of a high tension coil to support the coil and to maintain the arcing distance in the air among the high tension coil, an iron core, and a spacer tightening bolt in order to endure the lightning impulse withstand voltage.

To this end, the low tension coil support member 120 may be coupled to one end of the body block 110, and the high tension coil support member 130 may be coupled to the other end thereof.

In addition, the body block 110 includes a plurality of protrusions 111, a plurality of first grooves 112, and a plurality of second grooves 113. The plurality of protrusions 111 may be continuously formed on the outer peripheral portion of the body block 110 at regular intervals.

Further, the ends of the plurality of protrusions 111 may be formed to have a curved surface.

In addition, the plurality of first grooves 112 may be formed between the adjacent protrusions 111 so as to correspond to the plurality of protrusions 111.

Further, at least one second groove 113 may be formed on the side surface of the body block 110. The second groove(s) 113 may be formed on the outer peripheral surface of the body block on which the first grooves 112 are formed. That is, unlike the first grooves 112, the second groove(s) 113 is/are not formed between the protrusions 111 but is/are formed on the side surface of the body block 110 where the protrusions 111 are not formed.

The coil spacer structure 100 according to an embodiment of the present disclosure as described above has an increased creepage distance by means of the plurality of protrusions 111, the first grooves 112 and the second groove(s) 113. This allows the inventive coil spacer structure for the molding transformer to be able to maintain the arcing distance in the air at the low insulation class while enduring the lightning impulse withstand voltage of the high insulation class.

Figure 3:
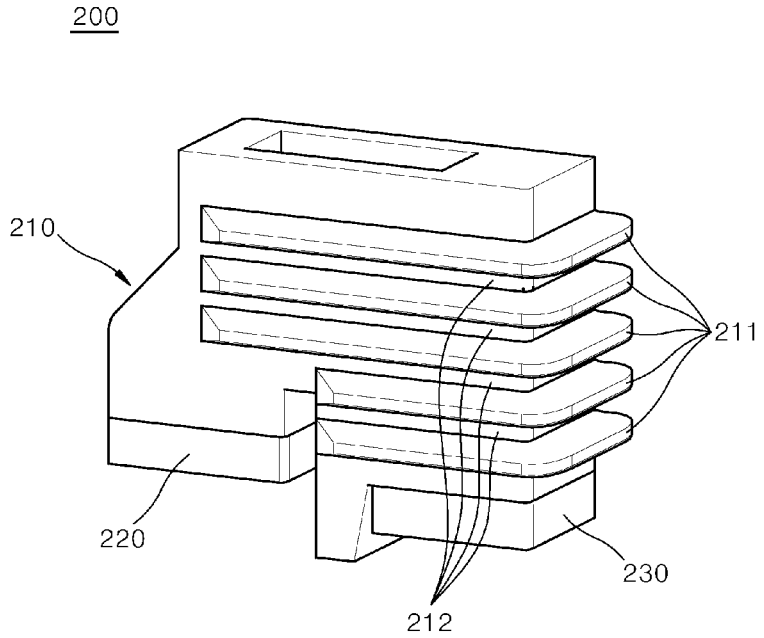
FIG. 3 is a perspective view schematically illustrating a coil spacer structure for a molding transformer according to a second embodiment of the present disclosure.

FIG. 3 is a perspective view schematically illustrating a coil spacer structure for a molding transformer according to a second embodiment of the present disclosure.

As illustrated, the coil spacer structure 200 includes a body block 210, a low tension coil support member 220, and a high tension coil support member 230.

More specifically, the low tension coil support member 220 may be coupled to one end of the body block 210, and the high tension coil support member 230 may be coupled to the other end thereof.

In addition, the body block 210 includes a plurality of protrusions 211 and a plurality of grooves 212. The plurality of protrusions 211 may be continuously formed on an outer peripheral portion of the body block 210 at regular intervals.

In addition, the plurality of protrusions 211 may be formed to have a curved surface.

Further, the plurality of grooves 212 may be formed between adjacent protrusions 111 so as to correspond to the plurality of protrusions 211.

Unlike the first coil spacer structure 100, the coil spacer structure 200 according to the second embodiment may be formed without the second grooves so that the degree of freedom in designing the protrusions and grooves may be increased.

Figure 4:
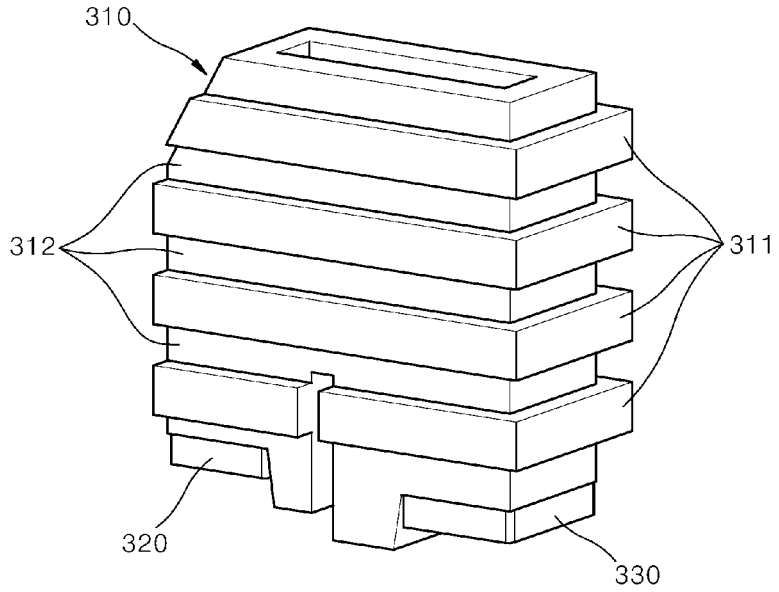
FIG. 4 is a perspective view schematically illustrating a coil spacer structure for a molding transformer according to a third embodiment of the present disclosure.

FIG. 4 is a perspective view schematically illustrating a coil spacer structure for a molding transformer according to a third embodiment of the present disclosure.

As illustrated, the coil spacer structure 300 includes a body block 310, a low tension coil support member 320, and a high tension coil support member 330.

In addition, the coil spacer structure 300 according to the third embodiment differs from the coil spacer structure 200 according to the second embodiment only in the shape of a plurality of protrusions.

More specifically, the body block 310 includes a plurality of protrusions 311 and a plurality of grooves 312. The plurality of protrusions 311 are continuously formed on an outer peripheral portion of the body block 310 at regular intervals.

Also, the outer peripheral surface of the plurality of protrusions 311 may be formed to have parallel surfaces corresponding to the plurality of grooves 312.

Figure 5:
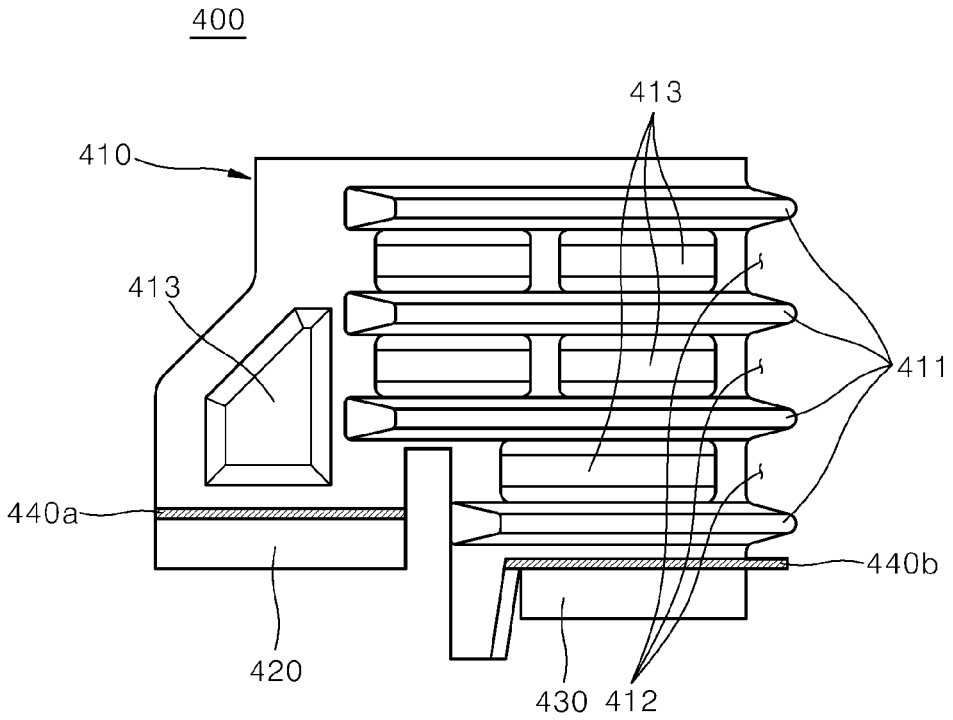
FIG. 5 is a front view schematically illustrating a coil spacer structure for a molding transformer according to a fourth embodiment of the present disclosure.
Figure 6:
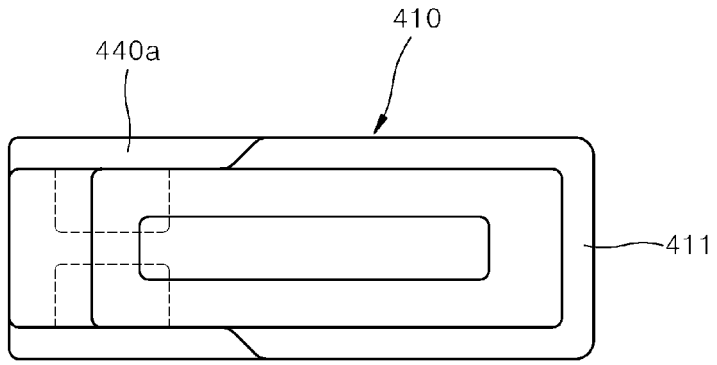
FIG. 6 is a schematic plan view of the coil spacer structure illustrated in FIG. 5.

FIG. 5 is a front view schematically illustrating a coil spacer structure for a molding transformer according to a fourth embodiment of the present disclosure, and FIG. 6 is a schematic plan view of the coil spacer structure illustrated in FIG. 5.

As illustrated, the coil spacer structure 400 further includes an impact resistant member compared to the coil spacer structure 100 illustrated in FIG. 1.

More specifically, the coil spacer structure 400 includes a body block 410, a low tension coil support member 420, a high tension coil support member 430, and an impact resistant members 440*a* and 440*b*.

The low tension coil support member 420 is coupled to one end of the body block 410 and the high tension coil support member 430 is coupled to the other end of the body block 410.

Thus, the impact resistant members may include a first impact resistant member 440*a* coupled between the body block 410 and the low tension coil support member 420 and a second impact resistant member 440*b* coupled between the body block 410 and the high tension coil support member 430.

In addition, the impact resistant members 440*a* and 440*b* may be coupled to the body block 410 so as to protrude from the body block 410 like protrusions 411 of the body block 410 in order to endure the impulse voltage and increase the creepage distance of the coil spacer as well.

Figure 7:
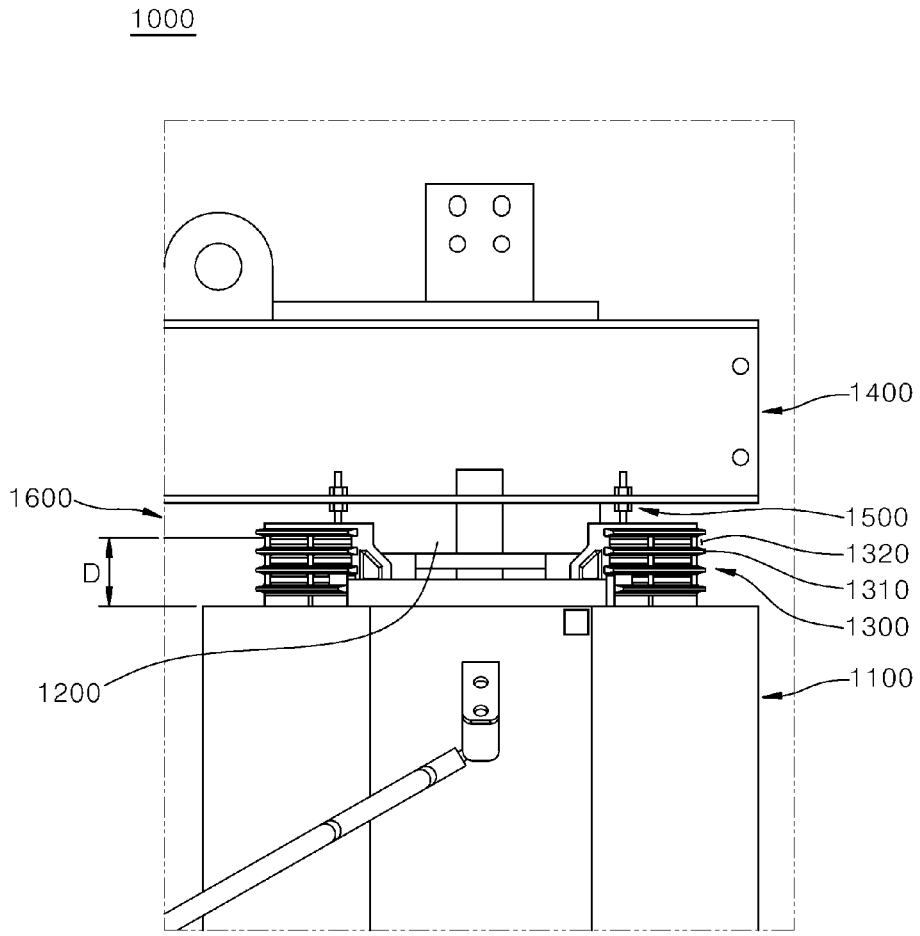
FIG. 7 is a partial front view schematically illustrating a molding transformer according to an embodiment of the present disclosure in which the inventive coil spacer structure is mounted on the molding transformer.

FIG. 7 is a partial front view schematically illustrating a molding transformer according to an embodiment in which a coil spacer structure according to the present disclosure is mounted.

As illustrated, the molding transformer 1000 includes a high tension coil 1100, a low tension coil 1200, a coil spacer 1300, an upper frame 1400, a spacer coupling member 1500 and an iron core 1600.

The coil spacer 1300 is positioned at the upper and lower portions of the high tension coil 1100 to support the coil.

Further, the coil spacer 1300 is formed with a plurality of protrusions 1310 and grooves 1320 to increase the creepage distance so that the arcing distance D in the air between the high tension coil 1100 and the iron core 1600 and the spacer coupling member 1500 can be minimized and at the same time the coil spacer can endure a high lightning impulse withstand voltage.

While the present disclosure has been described with reference to the attached drawings, it will be understood by a person having ordinary skill in the art that the present disclosure may be embodied in other specific forms without changing the spirit or essential characteristics thereof. It is therefore to be understood that the embodiments set forth above are illustrative only and not restrictive in all respects.

| | |
|---|---|
| 100: spacer structure | 110: body block |
| 111: a plurality of protrusions | 112: first groove |
| 113: second groove | 120: low tension coil support member |
| 130: high tension coil support member | |
| 200: structure | 210: body block |
| 211: a plurality of protrusions | 212: a plurality of grooves |
| 220: low tension coil support member | 230: high tension coil support member |
| 300: coil spacer structure | 310: body block |
| 311: a plurality of protrusions | 312: a plurality of grooves |
| 320: low tension coil support member | 330: high tension coil support member |
| 400: coil spacer structure | 410: body block |
| 411: protrusion | 420: low tension coil support member |
| 430: high tension coil support member | 440a: first impact resistant member |
| 440b: second impact resistant member | |
| 1000: molding transformer | 1100: high tension coil |
| 1200: low tension coil | 1300: coil spacer |
| 1400: upper frame | 1500: spacer coupling member |
| 1600: iron core | |

What is claimed is:

1. A coil spacer structure comprising:

a body block;

a low-tension coil support member coupled to the body block; and a high-tension coil support member coupled to the body block, wherein a plurality of protrusions are formed on an outer peripheral portion of the body block, and a first groove is formed between the protrusions, wherein at least one second groove is formed on the outer peripheral portion of the body block, wherein the at least one second groove is formed on a side surface of the body block where the protrusions are not formed.

2. The coil spacer structure of claim 1, wherein an end of the protrusions is formed to have a curved surface.

3. The coil spacer structure of claim 1, wherein an end of the protrusion is formed to have a plane parallel to the first groove.

4. The coil spacer structure of claim 1, further comprising;

a first impact resistant member coupled between the body block and the low tension coil support member; and a second impact resistant member coupled between the body block and the high tension coil support member.

* * * * *